US009117560B1

(12) United States Patent
Garino et al.

(10) Patent No.: US 9,117,560 B1
(45) Date of Patent: Aug. 25, 2015

(54) DENSIFIED WASTE FORM AND METHOD FOR FORMING

(71) Applicant: Sandia Corporation, Albuquerque, NM (US)

(72) Inventors: Terry J. Garino, Albuquerque, NM (US); Tina M. Nenoff, Albuquerque, NM (US); Dorina Florentina Sava Gallis, Albuquerque, NM (US)

(73) Assignee: Sandia Corporation, Albuquerque, MA (US)

( * ) Notice: Subject to any disclaimer, the term of this patent is extended or adjusted under 35 U.S.C. 154(b) by 5 days.

(21) Appl. No.: 14/081,025

(22) Filed: Nov. 15, 2013

(51) Int. Cl.
*G21F 9/16* (2006.01)
*G21F 9/34* (2006.01)

(52) U.S. Cl.
CPC ..... *G21F 9/34* (2013.01)

(58) Field of Classification Search
CPC ..... G21F 9/16; A62D 3/30
USPC ..... 588/15, 2, 313, 412, 901
See application file for complete search history.

(56) References Cited

U.S. PATENT DOCUMENTS

| | | | | |
|---|---|---|---|---|
| 7,241,932 | B2 * | 7/2007 | Maddrell | 588/11 |
| 2009/0305885 | A1 * | 12/2009 | Yamada et al. | 502/414 |

* cited by examiner

*Primary Examiner* — Edward Johnson
(74) *Attorney, Agent, or Firm* — Daniel J. Jenkins

(57) ABSTRACT

Materials and methods of making densified waste forms for temperature sensitive waste material, such as nuclear waste, formed with low temperature processing using metallic powder that forms the matrix that encapsulates the temperature sensitive waste material. The densified waste form includes a temperature sensitive waste material in a physically densified matrix, the matrix is a compacted metallic powder. The method for forming the densified waste form includes mixing a metallic powder and a temperature sensitive waste material to form a waste form precursor. The waste form precursor is compacted with sufficient pressure to densify the waste precursor and encapsulate the temperature sensitive waste material in a physically densified matrix.

19 Claims, 3 Drawing Sheets

DENSIFIED WASTE FORM AND METHOD FOR FORMING

STATEMENT CONCERNING FEDERALLY SPONSORED RESEARCH

This invention was developed under Contract DE-AC04-94AL85000 between Sandia Corporation and the United States Department of Energy. The U.S. Government has certain rights in this invention.

FIELD OF THE INVENTION

The present invention relates generally to methods and materials for sequestering and storage for disposal of temperature sensitive wastes. More specifically, the present invention is directed to sequestering and storage of temperature sensitive wastes from nuclear reactor fuel cycles and nuclear legacy wastes in a dense and durable waste form.

BACKGROUND OF THE INVENTION

Radioactive $^{129}I$ is one of the longer-lived fission products ($1.6\times10^7$ years) resulting from the generation of energy from nuclear fuels, and it is also one that is associated with considerable public concern by virtue of the mechanism whereby it may become concentrated in the human body where it can potentially have adverse health effects. Until recently in France, $^{129}I$ was discharged to the ocean for isotope dilution with the natural iodine in seawater.

With the growth of research on advanced fuel cycles in the United States and abroad, there is a strong interest in the separation and waste form development for all radioisotopes that are present in spent nuclear fuel once the components that can be incorporated into new fuel rods have been removed. This includes the initial trapping of gaseous iodine radioisotopes, and their incorporation into waste forms. During spent fuel reprocessing, the gaseous forms of radio-iodine (principally $I_2$, $CH_3I$, HI, and HIO) must be captured in a form that is suitable for long-term storage. Whether wastes are slated for above ground storage, or underground burial, a serious need is that the radionuclides (e.g., $^{129}I$) exist in highly insoluble chemical forms that will not be readily dissolved should water gain access to the site.

A second major consideration is that the wastes not exist as powders, since an accident during storage or handling could produce a cloud of radioactive dust with the potential for causing widespread contamination.

Nuclear fuel reprocessing is a technology that has been under development for more than half a century. During normal reprocessing activities, as the spent fuel is dissolved from the nuclear fuel rods, most of the radio-iodine is liberated and leaves as elemental iodine vapor. An international consensus has developed that incorporating radioisotopes into borosilicate glass waste forms is a convenient and acceptable (though not necessarily optimal) technology. Iodine, however, remains a notable exception, because conventional glass waste forms do not retain the iodine due to the high temperature necessary to melt the glass.

At this time, the leading technology for capturing radio-iodine from the reprocessing off-gases is sorption onto a silver-loaded zeolite matrix (where the iodine reacts with silver to form silver iodide, AgI). Recent studies at Sandia indicate that the iodine is sequestered in the form of sub-micron sized silver iodide (AgI) crystals on the internal and external surfaces of zeolite particles. One of our important research findings was that if the silver is loaded to the bulk surface (as opposed to ion exchanged into the zeolite pore), much of the iodine will be trapped on the bulk surface of the zeolite crystals, with only some of it in the channels and pores of zeolite crystal. Because of surface entrapment, mild heating causes easy release of the iodine as iodine gas. Additionally, zeolites are crushable metal oxides, and can easily form powders and dust if not protected from mechanical damage.

A different approach to solving this problem is to heat the silver-loaded zeolite matrix at a temperature sufficiently high (500°-700° C.), with or without pressure, to collapse the porous framework and create a densified/sintered ceramic that retains the iodine as AgI. However, the sintering temperature cannot be so high as to cause sublimation of the AgI (~600° C.), causing subsequent release of gaseous iodine. Unfortunately, in recent tests, commercially available silver-loaded zeolites were sintered, but did not produce the expected sequestering result because too much iodine was released during processing (likely due to the surface entrapment effect).

Either as produced by reaction with a Ag-zeolite or through direct reaction with metallic silver powder, AgI is a common host for $^{129}I$. AgI has a very low solubility in water as compared to other iodides ($3\times10^{-6}$ g/L or $1.3\times10^{-8}$ mol/L at 20° C.), but has a relatively high vapor pressure at moderate temperatures. It undergoes a $\beta$ to $\alpha$ phase change at 147° C., and it melts at 558° C. It has a vapor pressure of 10 mTorr at 600° C., which limits the thermal processing temperature. Thermal gravimetric analysis confirms that AgI begins to volatilize appreciably above 600° C. Known borosilicate glass-based waste forms are produced by melting the glass at high temperatures, >1000° C. Recent work has explored using low temperature (550° C.) sintering glass to encapsulate AgI or AgI-zeolite. However, this approach still requires thermal processing and is not suitable for use with even more temperature sensitive iodine absorbers such as metal-organic framework materials (MOFs) that can trap much higher levels iodine but typically began to decompose and/or release iodine at temperatures as low as 150° C.

Hence, a need exists for a highly stable binder or encapsulant material that securely sequesters particles of temperature sensitive waste, such as AgI, AgI-zeolite or iodine containing MOFs; and that has good mechanical strength, durability, low iodine outgassing, and low rates of leaching in groundwater.

Dense and durable waste forms for nuclear waste capable of room temperature fabrication using densifiable powder material, such as metal powder, that forms the matrix that encapsulates the radioactive components of the waste that do not suffer from one or more of the above drawbacks would be desirable in the art.

BRIEF DESCRIPTION OF THE INVENTION

The invention relates to materials and methods of making dense and durable waste forms for temperature sensitive waste material, such as nuclear waste, formed with low temperature processing using metallic powder that forms the matrix that encapsulates the temperature sensitive waste material.

In an exemplary embodiment, a densified waste form is provided. The densified waste form includes a temperature sensitive waste material in a physically densified matrix, the matrix being a compacted metallic powder.

In another exemplary embodiment, a method of forming a densified waste form is provided. The method includes mixing a metallic powder and a temperature sensitive waste material to form a waste form precursor. The waste form precursor is compacted with sufficient pressure to densify the waste precursor and encapsulate the temperature sensitive waste material in a physically densified matrix.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The present invention relates to materials and methods for forming densified waste forms for sequestering temperature sensitive waste material, such as radioactive iodine. This process is cost effective both because of the low material cost and because of the simple, room temperature process that avoids having to heat to high temperatures as is typically done with glass-based waste forms. The densified waste form includes high mechanical strength, high durability, low waste outgassing and low rates of leaching into groundwater over large spans of time. The waste form is suitable for radioactive materials, such as AgI, AgI-zeolite or I-containing Metal-Organic Framework (MOF) materials that contain radioactive iodine and are particularly temperature sensitive.

The densified waste form, according to the present disclosure, is a temperature sensitive waste material in a physically densified matrix of a metallic powder. As utilized herein, a "physically densified matrix" is a material subjected to a physical process having a matrix sufficiently dense to eliminate pores within the bulk of the matrix, have the pores within the matrix substantially isolated or having sufficiently few interconnections between pores to prevent the passage of gas or liquid through the bulk of the matrix. The physically densified matrix serves as an encapsulant to sequester, immobilize, and isolate the temperature sensitive waste material from the environment.

Figure 1:
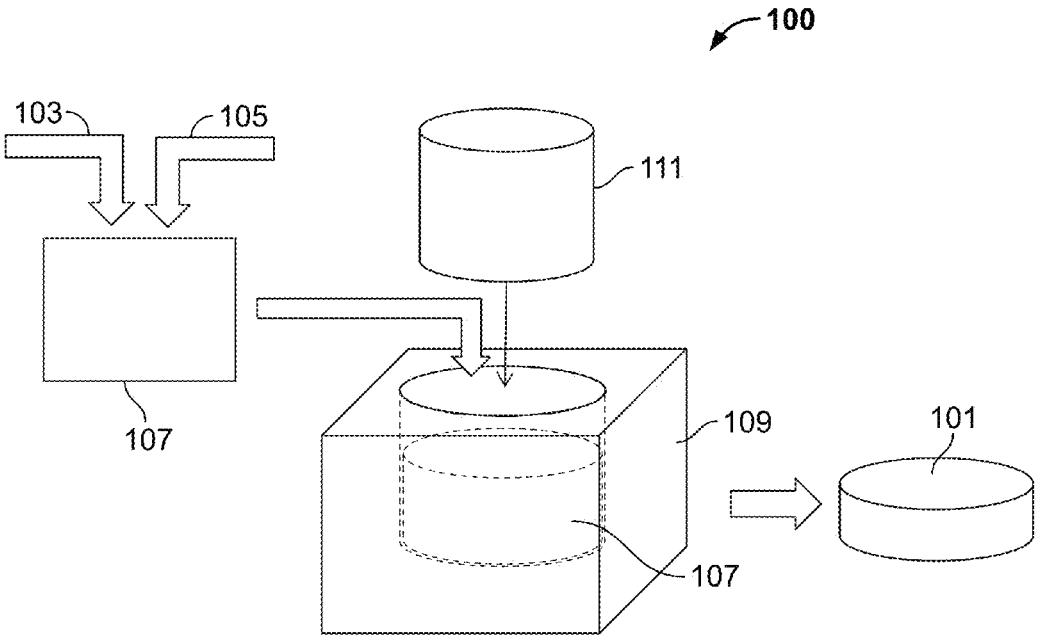
FIG. 1 is a schematic view of the method, according to the present disclosure.

The method includes making a densified waste form from powdered temperature sensitive waste materials, such as from nuclear fuel reprocessing, and a metallic powder. As shown in FIG. 1, the densification method 100 includes forming the densified waste form 101 from the metallic powder 103 and temperature sensitive waste material 105. The temperature sensitive waste material 105 and the metallic powder 103 are mixed to form a waste form precursor 107.

The metallic powder 103 is a particulate metal, alloy or material exhibiting metallic properties. The metallic powder 103 includes a material that is densifiable under pressure to a density sufficient to eliminate pores, have pores within the densified matrix substantially isolated or have sufficiently few interconnections between pores to prevent the passage of gas through the bulk of the matrix. The metallic powder 103 is a ductile material having high strength and chemical and environmental stability. Suitable metallic powders 103 include, but are not limited to, tin (Sn), gold (Au), silver (Ag) and copper (Cu) or combinations thereof. Typical particle sizes for the metallic powder 103 are from less than 100 micrometers or 10 to 100 micrometers or 10 to 50 micrometers. In one embodiment, the metallic powder 103 includes metal powder having greater than 95.0% by weight purity or greater than 99.0% by weight purity or greater than 99.9% by weight purity.

The temperature sensitive waste material 105 is a waste material that has undesirable properties, volatility, mobility or undesirable reactivity, when exposed to elevated temperatures. In an embodiment, the temperature sensitive waste material has a low vaporization temperature, making it desirable to use a process having a temperature below the vaporization temperature. For example, waste materials having a high vapor pressure may form hazardous vapors when exposed to elevated temperatures. Such hazardous vapors require additional containment and capture, further increasing the cost and complexity in waste management. For example, a volatility rate for AgI becomes unacceptable around 600° C. In another example, metal-organic frameworks decompose at lower temperatures of between about 150° C. and about 500° C.

In one embodiment, the temperature sensitive waste material 105 is an iodine-loaded material, such as iodine-loaded material formed in nuclear fuel reprocessing. In another embodiment, the temperature sensitive material is any suitable volatile fission gas that has been captured in metal-organic frameworks and/or Zeolites. Suitable volatile fission gasses include, but are not limited to, $^{85}$Kr, $^{3}$H, or a combination thereof.

In one embodiment, prior to mixing the temperature sensitive waste material 105 and the metallic powder 103, the temperature sensitive waste material 105 is formed by capturing iodine in an "adsorbant" to produce an iodine-loaded material. Examples of adsorbants include Ag, Ag-zeolite, Ag-mordenite, Zn, Cu, metal-organic frameworks, covalent organic frameworks, and bismuth/oxygen compounds. Some examples of iodine-loaded material include: AgI, AgI on a zeolite substrate (Ag-zeolite), Ag-mordenite (Ag-MOR), Ag-silica aerogel (Ag-aerogel), $ZnI_2$, CuI, iodine-loaded metal-organic frameworks, and a bismuth-oxy-iodine/iodide/iodate compound (e.g., $Bi_5O_7I$). In one embodiment, the range of composition in the temperature sensitive waste material 105 is from 0% of the material that contains the radioactive species, such as, but not limited to radioactive iodine, up to the percolation limit where the particles of that phase of the material would form a continuous network.

The temperature sensitive waste material 105 is converted to particles or powders by, for example, crushing or grinding. Typical particle sizes for the temperature sensitive waste material 105 are less than or equal to 50 micrometers. Suitable particle sizes include <40 micrometers, and from about 20 to 40 micrometers in size.

As utilized herein "powder", "particulate", "particles" and grammatical variations thereof are equivalent terms and include material that are finely divided and are sufficiently fine to permit intimate mixing.

Referring again to FIG. 1, the metallic powder 103 and temperature sensitive waste material 105 are mixed to form the waste form precursor 107. In one embodiment, the waste form precursor 107 includes temperature sensitive waste material 105 homogeneously distributed within the metallic powder 103. Alternatively, in other embodiments, the temperature sensitive waste material 105 can be inhomogeneously distributed within metallic powder 103. For example, the temperature sensitive material can be selectively positioned within the waste form precursor 107, for example, in the center of the waste form precursor 107 to further isolate the temperature sensitive waste material 105 from the atmosphere in the densified waste form 101. In one embodiment, AgI is homogeneously distributed throughout the waste form. The temperature sensitive waste material 105 is mixed with a metallic powder 103 prior to compaction.

As shown in FIG. 1, the waste form precursor 107 is provided to a die 109. The waste form precursor 107 is then compacted with die 109 and press 111 to sufficient pressure to densify the waste form precursor 107 and form the densified waste form 101. Sufficient pressure is applied to form a physically densified matrix encapsulating the temperature sensitive waste material 105. The pressure at which the compacting takes place can be, for example, greater than 12,500 psi or 12,500 to 30,000 psi or from 15,000 to 25,000 psi or from 17,500 to 20,000 psi. In one embodiment, the metallic powder 103 is tin powder and the pressure at which the waste form precursor 107 is compacted is 15,000 psi. While FIG. 1 shows the die 109 and press 111 for compacting the waste form precursor 107, the invention is not so limited and any suitable apparatus for compacting powders may be utilized.

The compacted metallic powder 103 forms a solid, physically densified matrix that surrounds and encapsulates the temperature sensitive waste material 105. The waste form precursor 107 is compacted to a density of greater than or equal to 80% density by volume or greater than or equal to 90% density by volume or greater than or equal to 95% density by volume.

The compacting of the waste form precursor 107 is performed at sufficiently low temperature to reduce or eliminate off-gassing of the temperature sensitive waste material 105. A suitable temperature includes room temperature. Another suitable temperature includes any temperature up to a melting point of the temperature sensitive waste material 105. In one embodiment, the compacting is performed with the addition of no external heat.

In another embodiment, the densified waste form 101 is coated with a material, such as a material devoid of temperature sensitive waste material. For example, a tin coating can be provided to the densified waste form 101. In this embodiment, the temperature sensitive material is further isolated from the environment, increasing the stability and environmental resistance for the densified waste form 101. In addition, the coating material may provide additional desirable properties for transportation and storage. In another example, the coating material provided to the densified waste form 101 includes the same metal as the metallic powder 103 mixed with the temperature sensitive waste material 105. In a further embodiment, the coating material and the metallic powder 103 mixed with the temperature sensitive waste material 105 are simultaneously pressed to form a monolithic structure.

Figure 5:
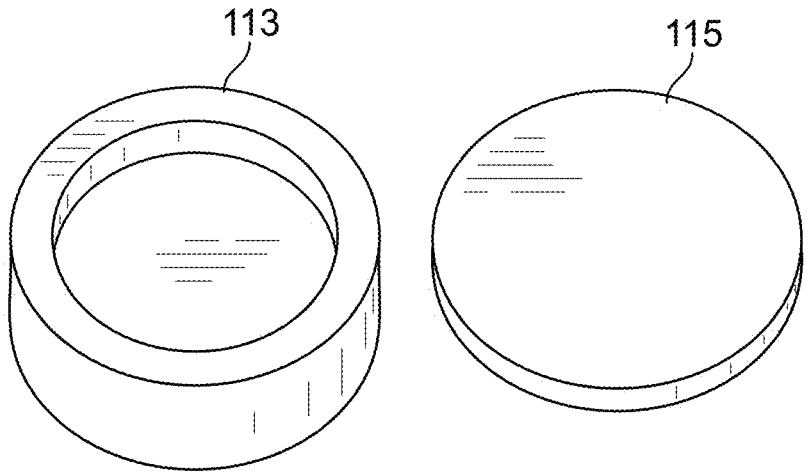
FIG. 5 shows a cup and a lid for encapsulating a densified waste form, according to an embodiment.
Figure 6:
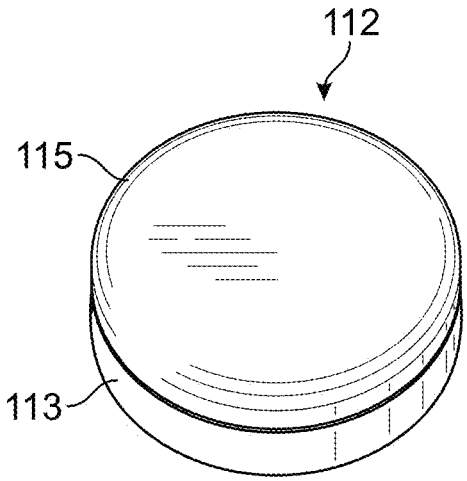
FIG. 6 shows a housing for encapsulating a densified waste form formed of cup and a lid, according to an embodiment.

In another embodiment, the densified waste form 101 is formed and a cladding material is joined to the densified waste form by cold welding or other suitable process. In another embodiment, the densified waste form is encapsulated in a housing 112. For example, referring to FIGS. 5 and 6, a housing 112 includes a cup 113 and a lid 115 produced from cast tin metal. The densified waste form 101 (not shown in FIG. 5) is placed in the cup 113 and the lid 115 is secured to the cup 113 at or near room temperature. The cup 113 and the lid 115 is secured is sealed by cold welding to form housing 112 (see FIG. 6). Cold welding includes grinding the surfaces of suitable ductile metals to remove any oxide coating, then putting the surfaces of the ductile metals in contact under low to moderate pressure, to weld the surfaces together. Low to moderate pressure, as used herein, refers to pressures of less than about 1000 psi. Using cold welding, suitable ductile metals such as tin can be welded at room temperature. Although FIG. 5 shows a cold welded housing 112 and a cast tin material, the housing 112 may be sealed by any suitable low temperature joining technique and may be formed from any suitable material.

EXAMPLE

Example 1

Figure 2:
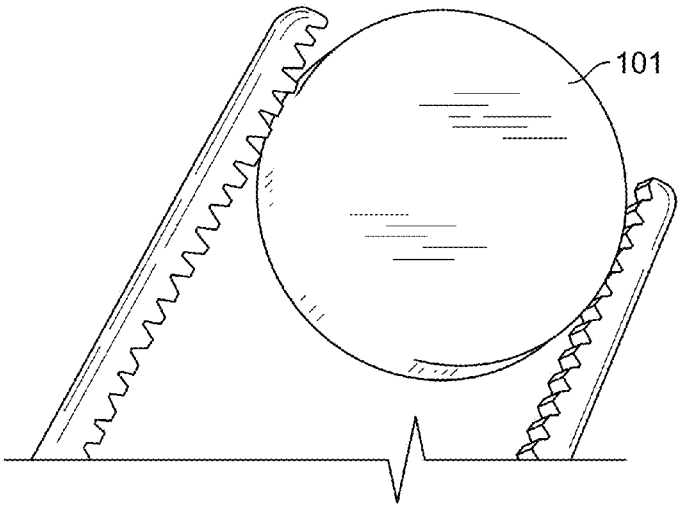
FIG. 2 shows a physically densified waste form having 90 wt. % Sn and 10 wt. % of 120 wt. % loaded $I_2$ @ ZIF-8 compacted at 25,000 psi.

A densified waste form, according to the present disclosure, was prepared and is shown in FIG. 2. A waste form precursor was prepared by mixing 90 wt. % Sn powder and a temperature sensitive waste form of 10 wt. % of a 120 wt. % loaded $I_2$ zeolite imidazolate framework (ZIF-8), a prototypical example of a metal-organic framework. The waste form precursor was uniaxially pressed using a steel die at 25,000 psi to form a densified waste form. The densified waste form is a solid, stable article suitable for storage. This preparation eliminates the use of prohibitively expensive Ag for both the getter material and the waste form.

Example 2

Figure 3:
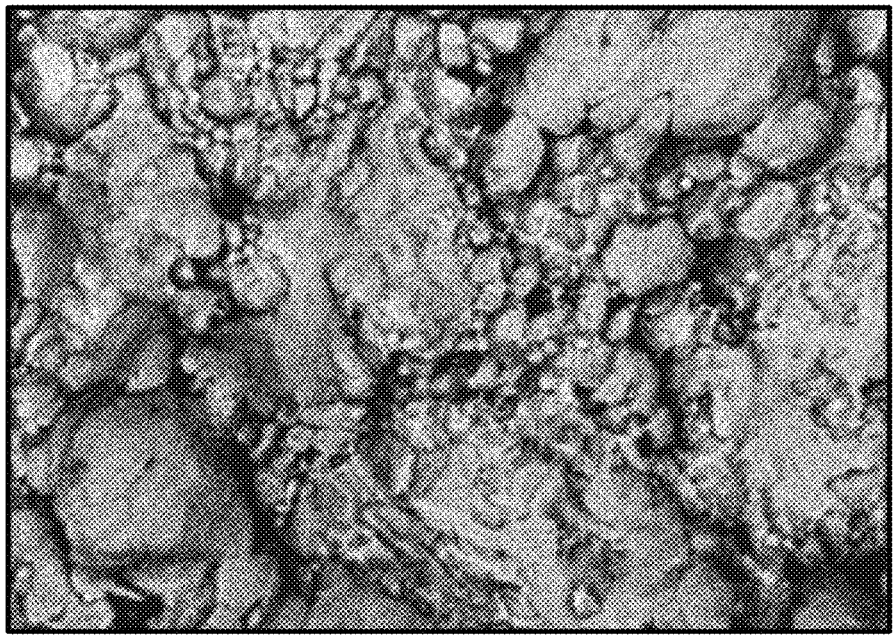
FIG. 3 shows a micrograph of a 75 wt. % Sn-25 wt. % AgI physically densified waste form, according to an embodiment.
Figure 4:
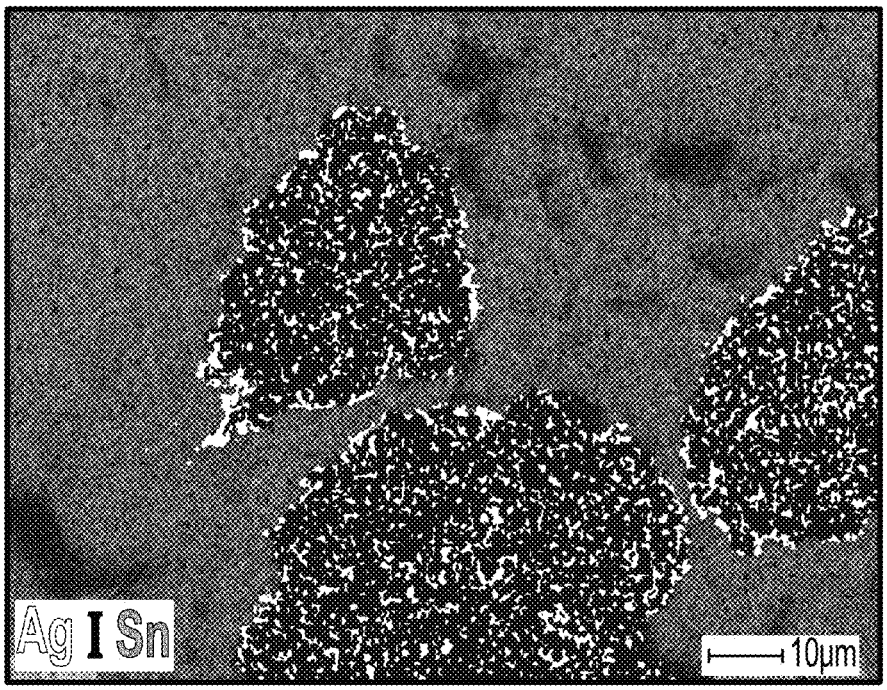
FIG. 4 shows a micrograph of a 75 wt. % Sn-25 wt. % AgI physically densified waste form, according to an embodiment.

A densified waste form, according to the present disclosure, was prepared. A densified waste form was prepared. A waste form precursor was prepared by mixing 75 wt. % Sn powder and a temperature sensitive waste form of 25 wt. % particulate AgI. The waste form precursor was pressed at 25,000 psi to form a densified waste form. FIGS. 3 and 4 show micrographs of the densified matrix, showing encapsulation and densification. FIG. 4 also shows regions of different elemental compositions as determined using energy-dispersive x-ray spectroscopy having different colors.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A densified waste form comprising:

a temperature sensitive waste material containing iodine in a physically densified matrix, the matrix being a compacted metallic powder;

wherein the compacted metallic powder is compacted at a temperature below the vaporization temperature of the temperature sensitive material; and wherein the temperature below the vaporization temperature is ambient temperature.

2. The densified waste form of claim 1, wherein the metallic powder includes a metal selected from the group consisting of tin, gold, silver, copper and combinations thereof.

3. The densified waste form of claim 1, wherein the physically densified matrix has a density of equal to or greater than 80% by volume.

4. The densified waste form of claim 1, wherein the physically densified matrix has a density of equal to or greater than 90% by volume.

5. The densified waste form of claim 1, wherein the physically densified matrix has a density of equal to or greater than 95% by volume.

6. The densified waste form of claim 1, wherein the temperature sensitive waste material containing iodine comprises an iodine-loaded material selected from the group consisting of AgI, AgI-zeolite, Ag-silica aerogel, $ZnI_2$, CuI, a bismuth-oxy-iodine compound, an iodine-loaded metal-organic framework, and combinations thereof.

7. The densified waste form of claim 6, wherein the iodine-loaded material comprises radioactive iodine.

8. The densified waste form of claim 6, wherein the AgI is homogeneously distributed throughout the waste form.

9. The densified waste form of claim 1, wherein the temperature sensitive waste material is up to 20% by weight of the densified waste form.

10. The densified waste form of claim 1, wherein the temperature sensitive waste material is up to 30% by weight of the densified waste form.

11. The densified waste form of claim 1, wherein the temperature sensitive waste material is up to 50% by weight of the densified waste form.

12. The densified waste form of claim 1, further comprising a coating, encapsulating or cladding material.

13. A method of forming a densified waste form, comprising:

a) mixing a metallic powder and a temperature sensitive waste material containing iodine to form a waste form precursor;

b) compacting the waste form precursor with sufficient pressure to densify the waste form precursor to encapsulate the temperature sensitive waste material in a physically densified matrix; and wherein the temperature below the vaporization temperature is ambient temperature.

14. The method of forming a densified waste form of claim 13, further comprising, prior to mixing, capturing a temperature sensitive waste material with an adsorbant, forming a temperature sensitive waste material.

15. The method of claim 13, wherein the metallic powder includes a metal selected from the group consisting of tin, gold, silver, copper and combinations thereof.

16. The densified waste form of claim 13, wherein the metallic powder includes tin.

17. The method of forming a densified waste form of claim 13, wherein the temperature sensitive waste material containing iodine is selected from the group consisting of AgI, AgI-zeolite, Ag-silica aerogel, $ZnI_2$, CuI, a bismuth-oxy-iodine compound, an iodine-loaded metal-organic framework, and combinations thereof.

18. The method of claim 17, wherein the iodine-loaded material comprises radioactive iodine.

19. The method of claim 13, further comprising coating, cladding or encapsulating the densified waste form precursor.

* * * * *